US006467654B1

(12) United States Patent
Ayres

(10) Patent No.: US 6,467,654 B1
(45) Date of Patent: Oct. 22, 2002

(54) PERSONAL HYGENIC CLEANSING LOTION AND DISPENSER

(76) Inventor: William R. Ayres, 163 Riverchase Cir., Sacramento, CA (US) 95864

( * ) Notice: Subject to any disclaimer, the term of this patent is extended or adjusted under 35 U.S.C. 154(b) by 0 days.

(21) Appl. No.: 10/003,327

(22) Filed: Nov. 2, 2001

(51) Int. Cl.[7] ..... B67D 5/06

(52) U.S. Cl. ..... 222/180; 222/192; 222/543

(58) Field of Search ..... 222/180, 181, 222/192, 543; 224/148.1, 148.4, 148.5, 202; 294/141; 206/225, 581

(56) References Cited

U.S. PATENT DOCUMENTS 2,350,184 A * 5/1944 Oys ..... 222/180
2,793,073 A * 5/1957 Bateman ..... 222/180
3,872,868 A * 3/1975 Kline ..... 222/180
4,280,643 A * 7/1981 Cordova et al. ..... 294/141
5,043,155 A 8/1991 Puchalski
5,167,354 A * 12/1992 Cohanfard ..... 224/148
5,413,261 A * 5/1995 Wu ..... 224/148.1
5,427,259 A * 6/1995 Krastanov ..... 224/148
5,577,647 A * 11/1996 Pittarelli et al. ..... 224/148.5
5,676,285 A * 10/1997 Vinarsky ..... 224/148.1
5,716,692 A 2/1998 Warner et al.
5,806,726 A * 9/1998 Ho ..... 222/181
5,810,218 A * 9/1998 Falcaro ..... 224/148.4
5,830,487 A 11/1998 Klofta et al.
5,976,521 A 11/1999 Briggs et al.
D422,508 S 4/2000 Restrepo
6,086,903 A 7/2000 Trinh et al.

* cited by examiner

*Primary Examiner*—Philippe Derakshani
*Assistant Examiner*—Thach H Bui

(57) ABSTRACT

A personal hygienic cleansing lotion and dispenser for further cleansing one's self after performing toiletry duties. The personal hygienic cleansing lotion and dispenser includes a special cleansing lotion comprising purified water, sorbitol, stearic acid, mineral oil, lanolin alcohol, dimethicope, emulsifying wax, and benzethonium chloride which is stored in a dispensing container having a dispensing cap. The dispensing container is designed to be attached to the toilet tissue holder for the purpose of accessibility. The lotion is to be applied to toilet tissue for extra personal hygienic cleaning.

7 Claims, 2 Drawing Sheets

PERSONAL HYGENIC CLEANSING LOTION AND DISPENSER

BACKGROUND OF THE INVENTION

1. Field of the Invention

The present invention relates to cleansing lotions and more particularly pertains to a new personal hygienic cleansing lotion and dispenser for further cleansing one's self after performing toiletry duties.

2. Description of the Prior Art

The use of cleansing lotions is known in the prior art. More specifically, cleansing lotions heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,086,903; U.S. Pat. No. 5,043,155; U.S. Pat. No. 5,716,692; U.S. Pat. No. 5,967,521; U.S. Pat. No. 5,830,487; and U.S. Pat. No. Des. 422,508.

While these devices fulfill their respective, particular objectives and requirements, the aforementioned patents do not disclose a new personal hygienic cleansing lotion and dispenser. The inventive device includes a special cleansing lotion comprising purified water, sorbitol, stearic acid, mineral oil, lanolin alcohol, dimethicope, emulsifying wax, and benzethonium chloride which is stored in a dispensing container having a dispensing cap. The dispensing container is designed to be attached to the toilet tissue holder for the purpose of accessibility. The lotion is to be applied to toilet tissue for extra personal hygienic cleaning.

In these respects, the personal hygienic cleansing lotion and dispenser according to the present invention substantially departs from the conventional concepts and designs of the prior art, and in so doing provides an apparatus primarily developed for the purpose of further cleansing one's self after performing toiletry duties.

SUMMARY OF THE INVENTION

In view of the foregoing disadvantages inherent in the known types of cleansing lotions now present in the prior art, the present invention provides a new personal hygienic cleansing lotion and dispenser construction wherein the same can be utilized for further cleansing one's self after performing toiletry duties.

The general purpose of the present invention, which will be described subsequently in greater detail, is to provide a new personal hygienic cleansing lotion and dispenser apparatus and method which has many of the advantages of the cleansing lotions mentioned heretofore and many novel features that result in a new personal hygienic cleansing lotion and dispenser which is not anticipated, rendered obvious, suggested, or even implied by any of the prior art cleansing lotions, either alone or in any combination thereof.

To attain this, the present invention generally comprises a special cleansing lotion comprising purified water, sorbitol, stearic acid, mineral oil, lanolin alcohol, dimethicope, emulsifying wax, and benzethonium chloride which is stored in a dispensing container having a dispensing cap. The dispensing container is designed to be attached to the toilet tissue holder for the purpose of accessibility. The lotion is to be applied to toilet tissue for extra personal hygienic cleaning.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new personal hygienic cleansing lotion and dispenser apparatus and method which has many of the advantages of the cleansing lotions mentioned heretofore and many novel features that result in a new personal hygienic cleansing lotion and dispenser which is not anticipated, rendered obvious, suggested, or even implied by any of the prior art cleansing lotions, either alone or in any combination thereof.

It is another object of the present invention to provide a new personal hygienic cleansing lotion and dispenser which may be easily and efficiently manufactured and marketed.

It is a further object of the present invention to provide a new personal hygienic cleansing lotion and dispenser which is of a durable and reliable construction.

An even further object of the present invention is to provide a new personal hygienic cleansing lotion and dispenser which is susceptible of a low cost of manufacture with regard to both materials and labor, and which accordingly is then susceptible of low prices of sale to the consuming public, thereby making such personal hygienic cleansing lotion and dispenser economically available to the buying public.

Still yet another object of the present invention is to provide a new personal hygienic cleansing lotion and dispenser which provides in the apparatuses and methods of the prior art some of the advantages thereof, while simultaneously overcoming some of the disadvantages normally associated therewith.

Still another object of the present invention is to provide a new personal hygienic cleansing lotion and dispenser for further cleansing one's self after performing toiletry duties.

Yet another object of the present invention is to provide a new personal hygienic cleansing lotion and dispenser which includes a special cleansing lotion comprising purified water, sorbitol, stearic acid, mineral oil, lanolin alcohol, dimethicope, emulsifying wax, and benzethonium chloride which is stored in a dispensing container having a dispensing cap. The dispensing container is designed to be attached to the toilet tissue holder for the purpose of accessibility. The lotion is to be applied to toilet tissue for extra personal hygienic cleaning.

Still yet another object of the present invention is to provide a new personal hygienic cleansing lotion and dispenser that lends itself to be readily available to those who want extra personal hygienic cleaning after using the toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
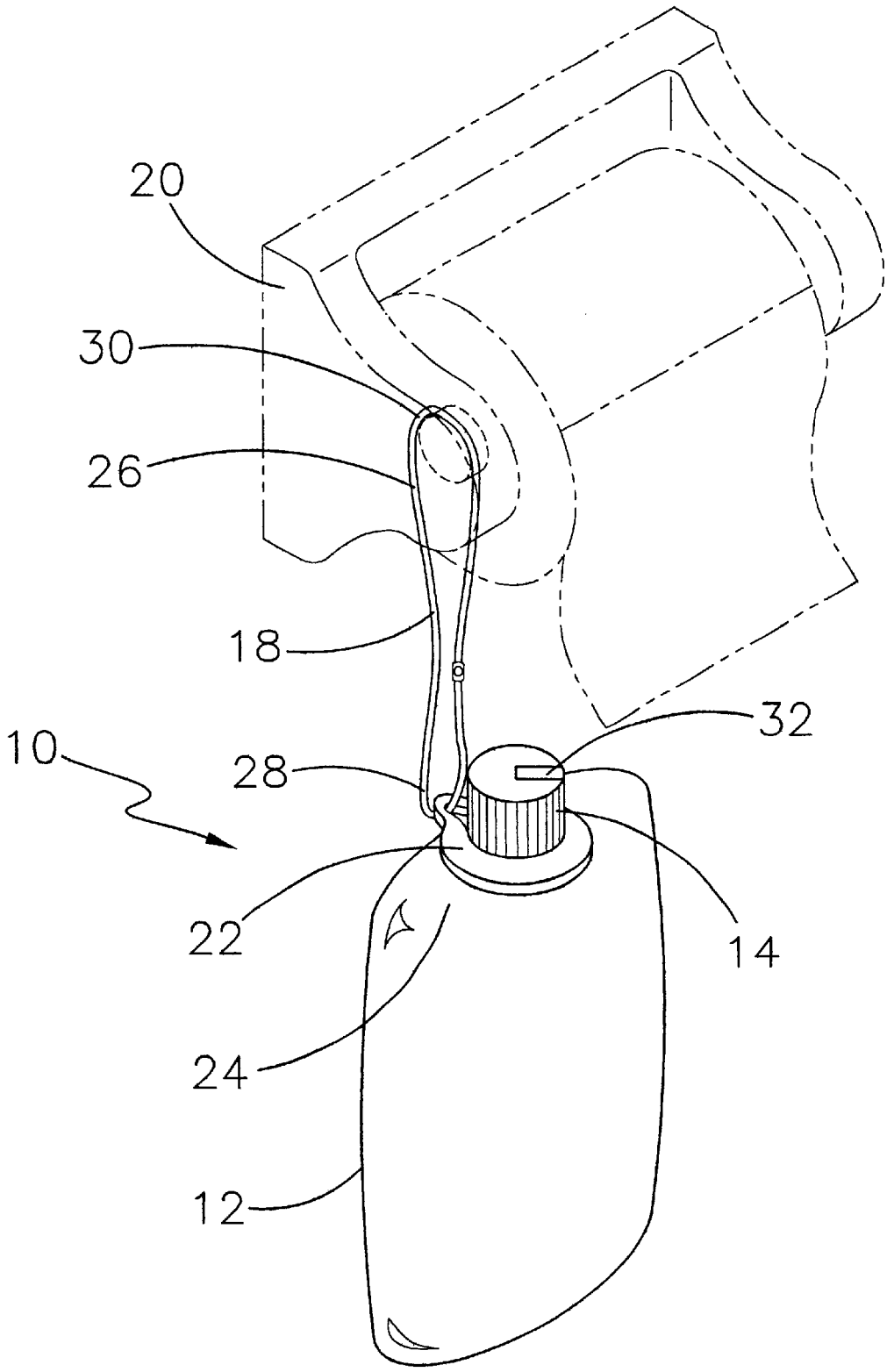
FIG. 1 is a perspective view of a new personal hygienic cleansing lotion and dispenser according to the present invention.
Figure 2:
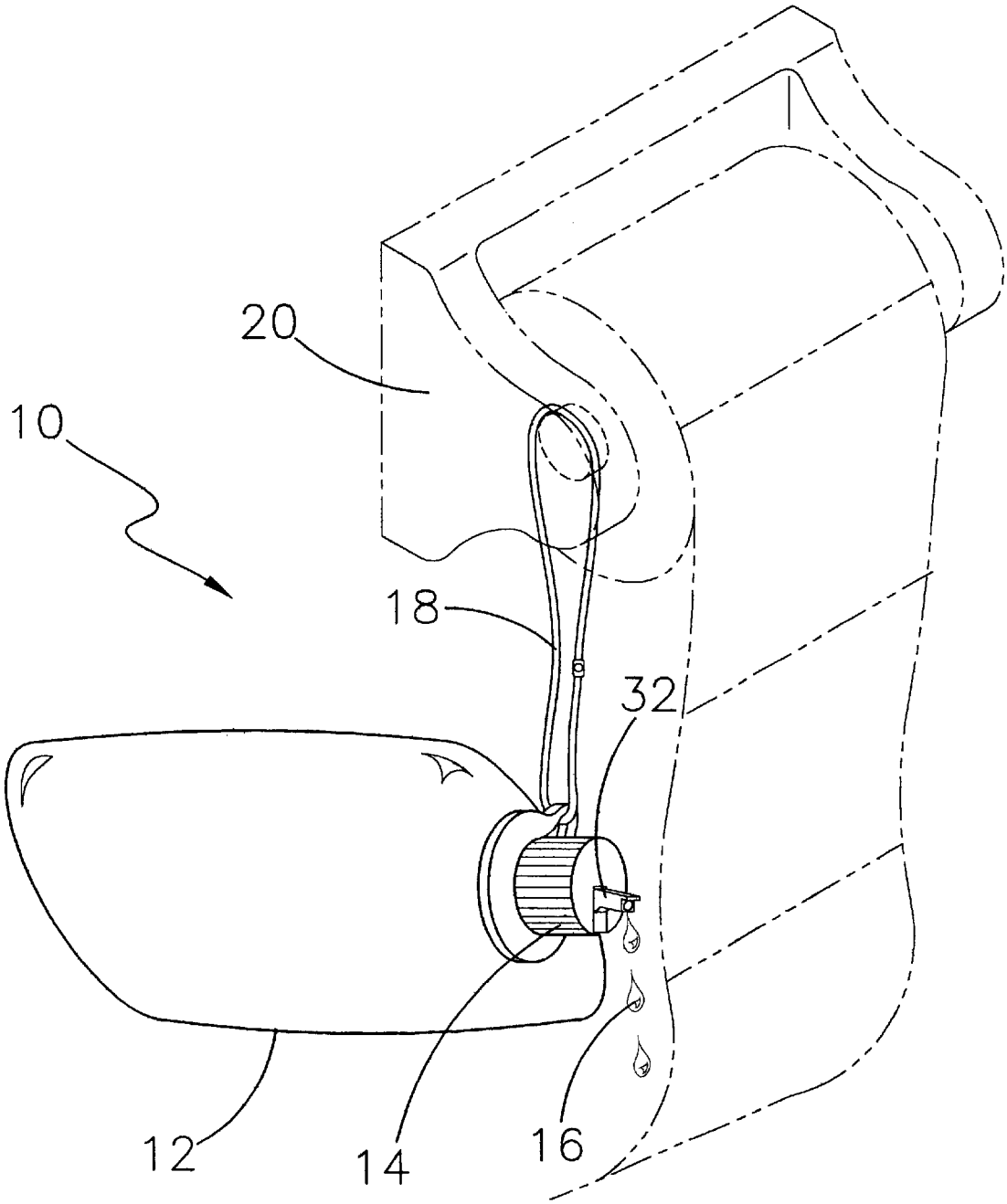
FIG. 2 is a perspective view depicting the use of the present invention.

With reference now to the drawings, and in particular to FIGS. 1 and 2 thereof, a new personal hygienic cleansing lotion and dispenser embodying the principles and concepts of the present invention and generally designated by the reference numeral 10 will be described.

As best illustrated in FIGS. 1 and 2, the personal hygienic cleansing lotion and dispenser 10 generally comprises a dispensing container 12. The dispensing container 12 has a dispensing cap 14.

The dispensing cap 14 is designed for dispensing a cleansing lotion 16.

The dispensing container 12 has a coupling strap member 18. The coupling strap member 18 is designed for selectively coupling the dispensing container 12 to a toilet roll hanger 20 such that the dispensing container 12 is readily available to a user.

The dispensing container 12 has a collar portion 22. The collar portion 22 is positioned between a body portion 24 of the dispensing container 12 and the dispensing cap 14 such that the collar portion 22 is designed for connecting to the coupling strap member 18 for the purpose of attaching the dispensing container 12 to the toilet roll hanger 20.

The coupling strap member 18 of the dispensing container 12 15 is elongate such that the coupling strap member 18 comprises a top end 26 and a collar end 28.

The collar end 28 of the strap member is slidably coupled to the collar portion 22 of the dispensing container 12.

The top end 26 of the strap member is designed for selectively coupling to the toilet roll hanger 20.

The top end 26 of the strap member includes a loop portion 30. The loop portion 30 is designed for being selectively couplable to the toilet roll hanger 20.

The dispensing cap 14 of the dispensing container 12 includes a spout member 32. The spout member 32 is designed for evenly dispersing the cleansing lotion in the dispensing container 12 to a user.

The cleansing lotion 16 of the dispensing container 12 comprises the following ingredients as a percentage by weight: purified water (87.075%); sorbitol (5.000%); stearic acid (2.500%); mineral oil and lanolin alcohol blend (2.000%); dimethicone (1.000%); emulsifying wax (1.000%); benzethonium chloride (0.2.00%) and propylparaben (0.025%).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A personal hygienic lotion composition and dispenser for further cleansing one's self after performing toiletry duties, the lotion composition and dispenser comprising:

a dispensing container having a body portion and a tubular neck portion mounted on and extending away from said body portion;

a dispensing cap for dispensing a cleansing lotion from said disposing container, said dispensing cap being threadably couplable to said neck portion of said dispenser container;

a collar member for selectively coupling to said dispensing container, said collar member comprising a plate having a container portion and a strap portion, said container portion being generally circular and having an outer diameter generally greater than an outside diameter of said neck portion of said dispensing container, said strap portion of said collar member forming an arcuate tab extending laterally away from said container portion of said collar member, said collar member having an aperture extending therethrough, wherein said aperture in said container portion is generally circular and has an inside diameter that is substantially equal to the outside diameter of said neck portion of said dispensing container such that said collar member is releasably attachable to said neck portion of said dispensing container, and an endless strap member being attached to said collar member and being looped through said arcuate slot of said collar member, wherein said dispensing container is selectively couplable to a toilet roll hanger such that said dispensing container is readily available to a user.

2. The lotion composition and dispenser as set forth in claim 1, further comprising:

said strap member comprising a flexible cord permitting movement of said container relative to the toilet roll hanger when said cord is attached to the toilet roll hanger, said cord having a top end and a collar end.

3. The lotion composition and dispenser as set forth in claim 2, further comprising:

said collar end of said strap member being slidably coupled to said collar portion of said dispensing container; and said top end of said strap member being adapted for selectively coupling to the toilet roll hanger.

4. The lotion composition and dispenser as set forth in claim 3, further comprising:

said top end of said strap member including a loop portion, said loop portion being adapted for being selectively couplable to the toilet roll hanger.

5. The lotion composition and dispenser as set forth in claim 1, further comprising:

said dispensing cap including a spout member, said spout member being adapted for dispersing said cleansing lotion from said dispensing container to a user.

6. The lotion composition and dispenser as set forth in claim 1, further comprising:

said cleansing lotion of said dispensing container comprising the following ingredients: purified water; sorbitol; stearic acid; mineral oil; lanolin alcohol; dimethicope; emulsifying wax; benzethonium chloride.

7. A personal hygienic cleansing lotion composition and dispenser for further cleansing one's self after performing toiletry duties, the lotion composition and dispenser comprising:

a dispensing container having a body portion and a tubular neck portion mounted on and extending away from said body portion;

a dispensing cap for dispensing a cleansing lotion from said disposing container, said dispensing cap being threadably couplable to said neck portion of said dispenser container;

a collar member for selectively coupling to said dispensing container, said collar member comprising a plate having a container portion and a strap portion, said container portion being generally circular and having an outer diameter generally greater than an outside diameter of said neck portion of said dispensing container, said strap portion of said collar member forming an arcuate tab extending away from said container portion, said collar member having an aperture extending therethrough, wherein said aperture is substantially circular in said container portion and has an inside diameter that is substantially equal to the outside diameter of said neck portion of said dispensing container such that said collar member is releasably attachable to said dispensing container, wherein said aperture extends into said strap portion of said collar member to define an arcuate slot when said collar member is attached to said dispensing container;

an endless strap member being attached to said collar member and being looped through said arcuate slot of said collar member, wherein said dispensing container is selectively couplable to a toilet roll hanger such that said dispensing container is readily available to a user;

said strap member comprising an endless cord having a top end and a collar end;

said collar end of said strap member being slidably coupled to said collar portion of said dispensing container;

said top end of said strap member being adapted for selectively coupling to the toilet roll hanger;

said top end of said strap member including a loop portion, said loop portion being adapted for being selectively couplable to the toilet roll hanger;

said dispensing cap including a spout member, said spout member being adapted for evenly dispersing said cleansing lotion from said dispensing container to a user; and said cleansing lotion of said dispensing container comprising the following ingredients as a percentage by weight: purified water (87.075%); sorbitol (5.000%); stearic acid (2.500%); mineral oil and lanolin alcohol blend (2.000%); dimethicone (1.000%); emulsifying wax (1.000%); benzethonium chloride (0.2.00%) and propylparaben (0.025%).

* * * * *